US006704539B2

(12) United States Patent
Nakayama

(10) Patent No.: US 6,704,539 B2
(45) Date of Patent: Mar. 9, 2004

(54) IMAGE-FORMING APPARATUS AND CLEANING BLADE

(75) Inventor: Yuji Nakayama, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/267,861

(22) Filed: Oct. 10, 2002

(65) Prior Publication Data

US 2003/0081971 A1 May 1, 2003

(30) Foreign Application Priority Data

Oct. 15, 2001 (JP) ..... 2001-316999

(51) Int. Cl.[7] ..... G03G 21/00
(52) U.S. Cl. ..... 399/350
(58) Field of Search ..... 399/343, 350, 399/351; 15/256.5

(56) References Cited

U.S. PATENT DOCUMENTS

| | | | | | |
|---|---|---|---|---|---|
| 4,823,161 | A | * | 4/1989 | Yamada et al. | 399/350 |
| 5,510,887 | A | * | 4/1996 | Watabe et al. | 399/350 |
| 5,701,571 | A | * | 12/1997 | Amamiya et al. | 399/343 |
| 6,002,911 | A | * | 12/1999 | Suzuki et al. | 399/350 |
| 6,055,404 | A | | 4/2000 | Yamazaki et al. | 399/350 |
| 6,128,462 | A | * | 10/2000 | Kato et al. | 399/350 |
| 6,311,037 | B1 | | 10/2001 | Hisakuni et al. | 399/350 |
| 6,453,146 | B1 | * | 9/2002 | Yamada et al. | 399/350 |
| 6,473,589 | B2 | * | 10/2002 | Hisakuni | 399/350 |

FOREIGN PATENT DOCUMENTS

| | | | |
|---|---|---|---|
| EP | 0947892 | * | 10/1999 |
| JP | 03-172856 | * | 7/1991 |

OTHER PUBLICATIONS

U.S. patent application Ser. No. 09/835,586, filed Apr. 17, 2001.

* cited by examiner

*Primary Examiner*—Sandra Brase
(74) *Attorney, Agent, or Firm*—Fitzpatrick, Cella, Harper & Scinto

(57) ABSTRACT

In a cleaning blade and an image-forming apparatus using a cleaning means having the cleaning blade, the cleaning blade is composed of an edge portion which is brought into contact with the image-bearing member and a support portion which brings the edge portion into contact with the image-bearing member, where the value at a peak temperature (t1) of a loss tangent of the edge portion, tan δ1, is smaller than the value at a peak temperature (t2) of a loss tangent of the support portion, tan δ2, and a curve which represents the temperature dependence of the loss tangent of the edge portion and a curve which represents the temperature dependence of the loss tangent of the support portion intersect at t1° C. or above to t1+40° C. or below. These can maintain the surface state of a photosensitive member that does not cause any smeared images or melt adhesion of toner even when non-magnetic toners are used, promising a great improvement in reliability, and also can deal with any situations even when the productivity has dramatically been advanced.

12 Claims, 4 Drawing Sheets

IMAGE-FORMING APPARATUS AND CLEANING BLADE

BACKGROUND OF THE INVENTION

1. Field of the Invention

This invention relates to an image-forming apparatus having a cleaning blade kept in contact with an image-carrying member such as an amorphous-silicon photosensitive member, and also relates to the cleaning blade.

2. Related Background Art

Nowadays, as image-forming apparatus of an electrophotographic system, complex machines having all output terminals such as a copying machine, a printer and a facsimile machine together have come to be accepted in the market. This means that electrophotographic systems have widely been accepted as output terminals adaptable to such a network. However, as one of great problems, the "duty cycle" has become a subject of discussion. The duty cycle herein refers to the limit number of sheets for which the main body continues being normally operated without any serviceman maintenance. One of the most important factors which determine the duty cycle is considered to be the lifetime of photosensitive drums.

From the viewpoint of ecology, it has also become absolute subjects for manufacturers to lessen any waste, i.e., to lessen any articles for consumption, make such articles for consumption have a longer lifetime and improve their reliability.

Moreover, with progression from conventional analog apparatus to digitized ones, it has also become absolute subjects to make the main-body cost equivalent to, or lower than, that of analog ones.

Furthermore, in recent years, in copying machines and printers, which have hitherto chiefly been held by black-and-white machines, originals or output files are rapidly increasingly being made full-color also in offices. Not only digital machines equivalent to analog machines but also full-color printers equivalent to black-and-white machines in respect of main-body cost and running cost have become absolute subjects. In order to settle such subjects, techniques which can dramatically lower TCO (total cost of ownership; total necessary cost viewed from users) are desired.

Under such circumstances, amorphous-silicon photosensitive members have become more and more widely used because of their high hardness (9,800 $N/m^2$ or more in Vickers hardness) and superior durability (running performance), heat resistance and environmental stability, and have become indispensable for high-speed machines which are required to have especially high reliability. The amorphous-silicon photosensitive members have replacement lifetime in a number of sheets which is at least one digit larger than OPC (organic photoconductor) photosensitive members commonly used in recent years. In other words, they have a lifetime equivalent to the main-body lifetime, and also have the effect on waste reduction. In addition, they do not take time and labor for, e.g., collection and regeneration of process cartridges making use of the OPC photosensitive members.

If the techniques making use of such amorphous-silicon photosensitive members mounted on high-speed machines come mountable on full-color printers, it is considered achievable to provide apparatus which can achieve the duty cycle and low running cost of the high-speed machine in respect of black-and-white printing and also can perform color printing. In particular, in order to achieve the duty cycle and low running cost of high-speed machines on the part of users who use black-and-white printing in a high percentage, it is considered essential to mount the amorphous-silicon photosensitive member on a one-drum type full-color printer making use of a rotary developing assembly.

However, in the apparatus of this type, the stuff adhering to the photosensitive-member (image-bearing member) surface to affect image quality are not only the toner. Any foreign matter having adhered to the photosensitive-member surface, such as fine paper dust coming from paper used as transfer materials in almost all cases, organic components depositing therefrom and corona products produced because of the presence of a high-pressure member in the apparatus, may cause low-resistance especially in a high-humidity environment to obstruct the formation of sharp electrostatic latent images. This is considered to be the factor which causes deterioration in image quality. Such a phenomenon of the deterioration in image quality is known to tend to occur in the case of the amorphous-silicon photosensitive member, which is constructed by forming films by glow discharge decomposition of silanes.

In order to avoid such a disadvantage, especially when one-component magnetic toners are used, a cleaning assembly is proposed in which a magnet roller is provided on the upstream side of a cleaning blade as viewed in the travel direction of the photosensitive member, to form a magnetic brush with part of the toner collected into the cleaning assembly, and this magnetic brush is brought into contact with the photosensitive-member surface to re-supply the magnetic toner thereto so that the foreign matter like the above can be removed by rubbing by the abrasive action attributable to toner particles at the blade portion.

In the means making use of such a magnetic brush, the abrasive action may hardly be localized non-uniformly on the photosensitive-member surface and may cause less deterioration of the photosensitive member, than the manner in which the photosensitive-member surface is rubbed with an abrasive member prepared separately such as a web or a rubber roller. In combination with such a method, an additional means may be used in which, e.g., the photosensitive member is provided with a heater so that its surrounding humidity can be kept low during night and stand-by to prevent the photosensitive-member surface from becoming low-resistance. This has achieved a certain effect to hold back image deterioration to be caused as stated above.

In image-forming apparatus which repeats the step of transferring transferable toner images formed on the photosensitive-member surface, to transfer materials chiefly comprised of paper, it is essential that residual toner remaining on the photosensitive member without being transferred to the transfer material at the timer of transfer is well removed each time.

Accordingly, as cleaning means, many proposals have been made up to now. Those in which the residual toner is scraped off by a cleaning blade comprised of an elastic materials such as urethane rubber are widely put into practical use because they are simple in construction, compact and low-cost and yet have good toner removal function. As a rubber material for the cleaning blade, urethane rubber is commonly used, as having a high hardness and yet being rich in elasticity, and excelling in wear resistance, mechanical strength, oil resistance and ozone resistance.

However, such a cleaning blade may cause filming on the photosensitive-member surface. The cause thereof is considered as follows: The photosensitive member has surface resistance which tends to become low-resistance. As factors which cause the photosensitive-member surface to have low resistance, fine paper dust coming from paper used as transfer materials in almost all cases, organic components depositing therefrom and various metal oxides and oxygen compounds produced at the time of high-energy corona discharge from a high-pressure member in the apparatus, together with any components becoming nitrate ions upon oxidation of nitrogen in air, may adhere to the photosensitive-member surface, so that a thin film (hereinafter "filming layer") is formed on the photosensitive-member surface as a result of long-term use.

Where a magnetic toner is used as a toner to perform magnetic brush development, the filming layer may readily be removed by the abrasive action of the toner particles at the cleaning blade. However, in the case of non-magnetic toners such as color toners, the toner particles have less abrasive action to tend to cause the filming layer. The filming layer may absorb moisture in a high-humidity environment to become low-resistance to obstruct the formation of sharp electrostatic latent images, and this may cause deterioration in image quality to cause, e.g., smeared images.

In order to remove the filming layer formed upon long-term use, the ability to rub the photosensitive-member surface must be improved. However, where, e.g., as a rubbing means an elastic roller is made to rub the photosensitive-member surface by bringing the former into contact with the latter at a peripheral speed made different from each other, the toner may locally adhere to the photosensitive-member surface. As the result, the toner may locally melt-adhere to the elastic roller surface, and the photosensitive-member surface may be abraded at the part corresponding thereto, resulting in uneven abrasion to cause faulty images.

If the photosensitive-member surface is made more highly abradable with the elastic roller in order to avoid the above problem, even the amorphous-silicon photosensitive member may wear in a large quantity to lower its reliability. Also, with such setting, the elastic roller itself also may wear in a large quantity to lower its reliability.

According to experiment made by the present inventor by an optical method, it has been ascertained that the filming layer due to long-term use is in a layer thickness of approximately from 3 to 8 nm. Its measurement with a reflection spectro-interferometer (manufactured by Otsuka Denshi K.K.; trade name: MCDP2000) at the initial stage of continuous use has also ascertained a filming layer. Then, it has been found that this filming layer reaches the layer thickness of from 3 to 8 nm, and after that the layer thickness little changes, but any image deterioration which had been eliminable at the initial stage by dry wiping, wet wiping or alcohol wiping becomes not eliminable as the photosensitive member is used for a longer term.

It has been found that the drum (photosensitive member) surface having reached such a state as a result of long-term use and with repetition of melt adhesion and wear must be polished with abrasive grains before the image deterioration can be eliminated; abrasive grains being those of cerium oxide ($CeO_2$) of approximately from 0.3 $\mu$m to 2 $\mu$m in diameter dispersed in alcohol or the like. This tends to remarkably occur especially when a drum heater is not fitted.

In addition, the present inventor has put forward extensive studies and has examined photosensitive-member surfaces having various surface shapes by measuring their surfaces at the initial stage and after long-term use, with an AFM (atomic force microscope; manufactured by Digital Instruments Co.; trade name: ManoScope IIIa Dimension 3000; scanning mode: tapping mode; scanning range: 20 $\mu$m×20 $\mu$m; probe: silicon cantilever). As the result, it has been found that the photosensitive-member surfaces after long-term use have become almost smooth because of wear, compared with those at the initial stage. Also, as a result of heating (at 70° C. to 80° C. for 30 minutes) the photosensitive-member surfaces after long-term use, in an aqueous 5% sodium peroxodisulfate ($Na_2S_2O_8$) solution, followed by ultrasonic cleaning (for about 1 minute) in acetone and then rinsing with an ethanol/pure water mixed solvent, it has been found that the level of filming is large especially at dales of unevenness of the photosensitive-member surface.

The filming may also result in an increase in frictional force. An experiment made by the present inventor has revealed that the frictional force acting between the transfer residual toner and the drum surface through the cleaning blade may increase because of the long-term use. This is considered due to the fact that the filming layer formed in the long-term use makes higher the adhesion and affinity between the cleaning blade and the drum surface and between the transfer residual toner and the drum surface to increase the frictional force acting between the transfer residual toner and the drum surface.

The increase in frictional force is considered due to an increase in shear stress of the cleaning blade, shear stress between toner particles and shear stress in the vicinity of the drum surface. As a result of the increase in these, the cleaning blade may chip (its edge may chip locally), heat may be generated in a large amount because of an increase in compression set shear stress to cause melt adhesion of toner, or fatigue wear may increase because of an increase in stress inside the drum, as so considered.

The melt adhesion of toner may also occur with a lapse of continuous operating time. In recent years, as stated previously, image-forming apparatus are not only used to function as copying machines but also used widely as printers. Also, with progress in the enrichment of auxiliary functions such as a feeder function and a sorter function, it has become possible to perform continuous operation on 4,000 sheets or more at one job. For example, in the case of a type of machine which can process 50 sheets of A4-sized paper in one minute, it follows that the continuous operation is performed for 80 minutes or more even in simple estimation. Under such circumstances, the atmospheric temperature reaches almost 50° C. in the vicinity of the photosensitive member, and is considered to have reached a temperature higher than that at the contact part (nip) between the cleaning blade and the photosensitive member. Hence, the melt adhesion of toner to the photosensitive-member surface is considered to occur highly frequently.

Where two-component developers are used, there is also such a problem that any suitable preventive means can not be taken. Toners for full-color image formation are commonly non-magnetic materials. Conventionally, where the magnetic brush cleaning having been widely used in black-and-white machines is applied to full-color printers, a magnetic carrier must be kept held previously in a cleaner unit. This may result in insufficient reliability and durability (running performance).

SUMMARY OF THE INVENTION

The present invention was made in order to cope with the problems stated above. Accordingly, an object of the present invention is to provide an image-forming apparatus which can maintain the surface state of a photosensitive member that does not cause any smeared images or melt adhesion of toner even when non-magnetic toners are used, promising a great improvement in reliability, and also can deal with any situations even where the productivity has dramatically been advanced.

Another object of the present invention is to provide a cleaning blade useful for such an image-forming apparatus.

To achieve the above objects, the present invention provides an image-forming apparatus comprising a cleaning means provided with at least a cleaning blade, and an image-bearing member to be cleaned by the cleaning member, wherein;

the cleaning blade comprises an edge portion which is brought into contact with the image-bearing member, and a support portion which brings the edge portion into contact with the image-bearing member;

the value at a peak temperature (t1) of a loss tangent of the edge portion, tan δ1, is smaller than the value at a peak temperature (t2) of a loss tangent of the support portion, tan δ2; and a curve which represents the temperature dependence of the loss tangent of the edge portion and a curve which represents the temperature dependence of the loss tangent of the support portion intersect at t1° C. or above to t1+40° C. or below.

When the loss tangent of the edge portion of the cleaning blade and the loss tangent of the support portion satisfy the above relationship, the edge portion behaves always stably against the photosensitive-member surface and the residual toner on the photosensitive-member surface. As a result, the lower-limit pressure at which the residual toner slips through can be set low, so that the melt adhesion of toner to the photosensitive-member surface can be reduced and the filming can be kept from occurring.

The temperature dependence of the loss tangent of the edge portion may be measured with a viscoelastometer (e.g., one manufactured by Rheometrix Co.; trade name: RSA2) at 10 Hz on a sample obtained by cutting out only the edge portion of the cleaning blade. The temperature dependence of the loss tangent of the support portion may also be measured with a viscoelastometer (e.g., one manufactured by Rheometrix Co.; trade name: RSA2) at 10 Hz on a sample obtained by cutting out only the support portion of the cleaning blade.

The image-forming apparatus of the present invention is an image-forming apparatus of an electrophotographic system, having a photosensitive member, a charging means, an exposure means, a developing means, a transfer means and a cleaning means, in which as a developer used is a developer containing at least non-magnetic toner particles and a magnetic carrier or a developer containing at least a magnetic toner. In this image-forming apparatus, the cleaning means cleaning blade is a cleaning blade having a cured layer formed at its edge portion (its edge and the vicinity thereof) which comes into contact with the image-bearing member, by impregnating that portion with an isocyanate compound followed by curing, and the behavior concerning loss tangents, the thickness of the impregnation-treated portion, the level of wear and so forth are controlled. Thus, it can maintain the surface state of a photosensitive member that does not cause any smeared images or melt adhesion of toner even when non-magnetic toners are used, promising a great improvement in reliability, and also can deal with any situations even where the productivity has dramatically been advanced.

In the case of an image-bearing member which has a high surface hardness, may abrade with difficulty and may wear at a small level, the melt adhesion of toner and the filming are liable to occur. However, the use of the cleaning blade having the characteristics as described above can keep the melt adhesion of toner and the filming from occurring.

The image-forming apparatus of the present invention may also be so constructed as to have a plurality of developing means in addition to the above construction so that full-color images can also be formed.

DESCRIPTION OF THE PREFERRED EMBODIMENTS

The image-bearing member is a drum-type photosensitive member provided rotatively. When the photosensitive member has been rotated 10,000 times, the photosensitive-member surface layer having been abraded and removed by the cleaning blade may preferably have a layer thickness of 50% or less, more preferably 10% or less, still more preferably 1% or less, and most preferably 0.5% or less, of the layer thickness of the photosensitive-member surface layer before it is abraded.

Even when the photosensitive member has been rotated 10,000 times, it is also preferable for the surface layer of the photosensitive member substantially to stand non-worn.

The level of abrasion of the photosensitive-member surface layer when the photosensitive member has been rotated 10,000 times may be evaluated by measuring the depth of abrasion with a reflection spectro-interferometer (manufactured by Otsuka Denshi K.K.; trade name: MCDP2000).

The image-forming apparatus of the present invention may preferably be an image-forming apparatus of an electrophotographic system, having a photosensitive member, a charging means for providing the outer surface of this photosensitive member with electric charges, an exposure means for exposing the charged photosensitive member to light to form on the photosensitive member an electrostatic latent image corresponding to an image to be formed, a developing means for feeding a developer to the photosensitive member on which the electrostatic latent image has been formed, to form a toner image, a transfer means for transferring to a transfer material the toner image formed on the photosensitive member, and a cleaning means for removing the toner remaining on the photosensitive member after transfer, in which as the developer used is a developer containing at least non-magnetic toner particles and a magnetic carrier or a developer containing at least a magnetic toner. The cleaning means cleaning blade may preferably be a cleaning blade having a cured layer formed at its edge portion (its edge and the vicinity thereof) which comes into contact with the photosensitive member, by impregnating that portion with an isocyanate compound followed by curing. Such an impregnation-treated portion may preferably be in a thickness of from 0.12 to 1.2 mm. Employment of such construction enables the filming to hardly occur on the photosensitive member in its long-term use.

Figure 4A:
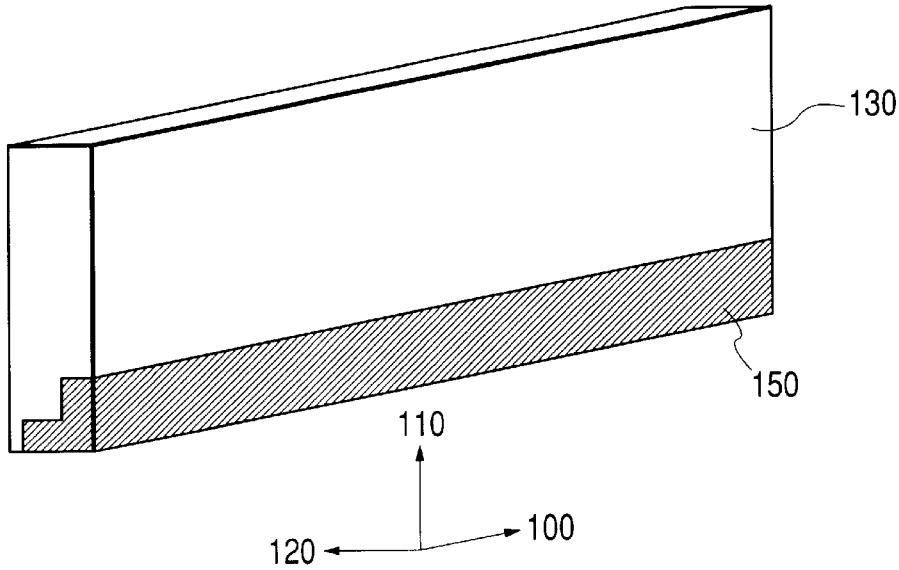
FIGS. 4A and 4B are a diagrammatic perspective view (FIG. 4A) and a diagrammatic sectional view (FIG. 4B), for describing the cleaning blade of the present invention.
Figure 4B:
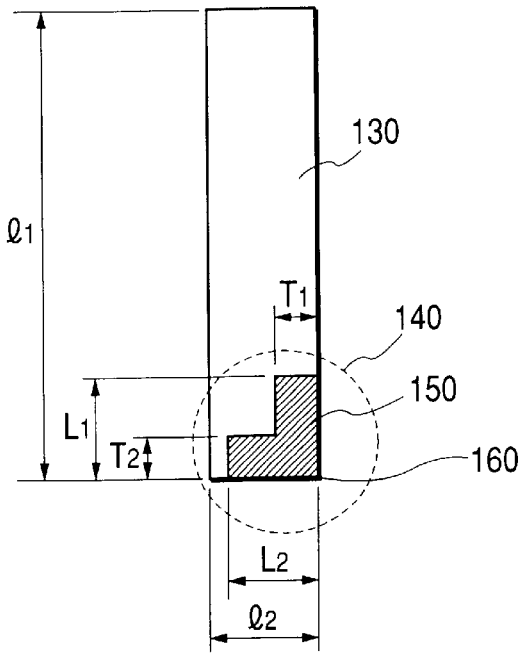

FIGS. 4A and 4B show an example of the cleaning blade. In this example, as the edge portion, a cured layer (impregnation-treated portion) 150 having a sectional shape of the letter L is formed at an edge portion 140 inclusive of an edge 160, and uniformly with respect to the lengthwise direction 100 of the cleaning blade. Also, the edge portion 150 is brought into contact with the image-bearing member by a support portion 130.

In FIG. 4B, L1 represents the length of the cured layer in its free-length direction; L2, the length of the cured layer in its thickness direction; and T1 and T2, each the thickness of the cured layer. Also, in FIG. 4A, reference numeral 110 denotes the free length of the cleaning blade; and 120, the thickness of the cleaning blade.

In order to make sufficient the effect attributable to the cured layer, the L1 may preferably be 0.2 mm or more, more respectively 0.5 mm or more, and still more preferably 1 mm or more. Setting the L1 within the range described here can keep linear pressure from steeply becoming higher when the contact portion (edge) is thrust into the photosensitive-member surface, and hence a stable linear pressure can be ensured.

The free length 110 may commonly be from 5 mm to 15 mm.

In order to make sufficient the effect attributable to the cured layer, the L2 may preferably be 0.2 mm or more, more respectively 0.5 mm or more, and still more preferably 1 mm or more. Also, it is not larger than the blade thickness 120.

The T1 and T2 may each preferably be 0.12 mm or more, more preferably 0.13 mm or more, and still more preferably 0.15 mm or more, and may each preferably be 1.2 mm or less, more preferably 1.1 mm or less, and still more preferably 1.0 mm or less. As long as the thickness of the cured layer is within such ranges, good properties of the contact portion (edge) of the cleaning blade can be maintained over a long period of time even if the contact portion of the cleaning blade has worn. Moreover, since the cured layer has a sufficient thickness, the contact portion of the cleaning blade can be kept from being greatly deformed because of its rubbing against the image-bearing member. Hence, any fine toners and spherical toners which are being frequently used in recent years can also be effectively removed.

The cleaning means is a means for removing the toner remaining on the photosensitive member after transfer, and a cleaning means is employed which has an elastic blade (cleaning blade) molded chiefly of a polyurethane resin and coming into contact with the photosensitive member.

Taking note of urethane linkage groups having active hydrogen which are originally present in the polyurethane resin, the edge portion of the cleaning blade may preferably be one produced by allowing an isocyanate compound and the polyurethane resin to combine firmly through allophanate linkages to form a cured layer, and further subjecting to self polymerization excess isocyanate compound not reacting with the active-hydrogen compound.

In particular, the cured layer may preferably be formed by impregnating the cleaning blade edge portion with at least the isocyanate compounded and thereafter allowing the polyurethane resin and the isocyanate compound to react with each other.

According to such a method, the isocyanate compound can be incorporated without impregnation with the active-hydrogen compound. In this respect, the method can be smaller in the number of production steps and lower in cost than conventional methods. Also, the tip (edge) of the cleaning blade is low in friction and also is covered with the cured layer, and hence it may be hard to deform by frictional force with the contact object member, so that the edge can always maintain a sharp shape. Hence, this is very advantageous in order to achieve at the same time the cleaning performance for fine toners or spherical toners, in particular, toners different in type.

The electrophotographic cleaning blade of the present invention employs as its base material a polyurethane having a JIS-A hardness of from 60 to 80 degrees as defined in JIS K6253, and hence is flexible and rich in rubber elasticity as the whole blade. As the polyurethane resin that forms the blade base material in the present invention, those obtained by allowing a high-polymer polyol, a polyisocyanate and a curing agent to react with one another may be used. Before curing, a catalyst usually used for the curing of urethane may also be used.

As the high-polymer polyol, usable are polyester polyols, polyether polyols, caprolactone ester polyols, polycarbonate ester polyols and silicone polyols. Those having a weight-average molecular weight of usually from 500 to 5,000 may be used. Examples are by no means limited to these.

The polyisocyanate may include, but not limited to, diphenylmethane diisocyanate (MDI), tolylene diisocyanate, naphthalene diisocyanate and hexamethylene diisocyanate.

The curing agent (cross-linking agent) may include 1,4-butanediol, 1,6-hexanediol, ethylene glycol and trimethylol propane. Also, the catalyst may include triethylenediamine. They are by no means limited to these.

As molding methods for the cleaning blade, usable are a one-shot method in which the above components are mixed at one time and the mixture obtained is casted into a mold or a centrifugal-molding cylindrical mold; a prepolymer method in which an isocyanate and a polyol are previously allowed to react to form a prepolymer, and thereafter the cross-linking agent is mixed, which are then casted into a mold or a centrifugal-molding cylindrical mold; and a semi-one-shot method in which a semi-prepolymer obtained by allowing a polyol to react with an isocyanate and a curing agent obtained by adding a polyol to a cross-linking agent are allowed to react, and the reaction product obtained is casted into a mold or a centrifugal-molding cylindrical mold.

The cleaning blade thus formed may preferably have a JIS-A hardness of commonly from 60 to 85 degrees. As long as it has a JIS-A hardness of 60 degrees or more, a sufficient force of contact with the contact object member can be ensured. As long as it has a JIS-A hardness of 85 degrees or less, the contact object member can be kept from being damaged.

As a method of forming the edge portion of the cleaning blade, a method is preferred in which the specific part of the cleaning blade obtained by molding as described above is impregnated with the isocyanate compound, followed by heating to effect curing to form the cured layer from the surface of urethane to the interior thereof.

When the edge portion of the cleaning blade is impregnated with the isocyanate compound, it may be done on a blade member alone, or in the state that a support member is kept joined. It may also be done on a sheet having not yet been cut into cleaning blades, or on those with support members.

When only the edge portion is impregnated therewith, a method may be employed in which the part not to be impregnated is masked with a chemical-resistant tape or the like, or only the part to be impregnated is immersed in the isocyanate compound.

As a further method by which the blade member is impregnated with the isocyanate compound, for example a method may be employed in which the isocyanate compound is kept at a temperature at which it stands liquid and the blade member is immersed therein, or a fibrous material or porous material is impregnated with the isocyanate compound and this is applied onto the blade member. Still further, the isocyanate compound may be sprayed to coat the blade member. The isocyanate compound in the course of immersing the blade member therein, that in the course of coating and that after the coating may each likewise be kept at a temperature at which the isocyanate compound stands liquid. In this way, the urethane blade member is impregnated with the isocyanate compound. After a stated time, any isocyanate compound remaining on the urethane blade member is wiped off.

Figure 3A:
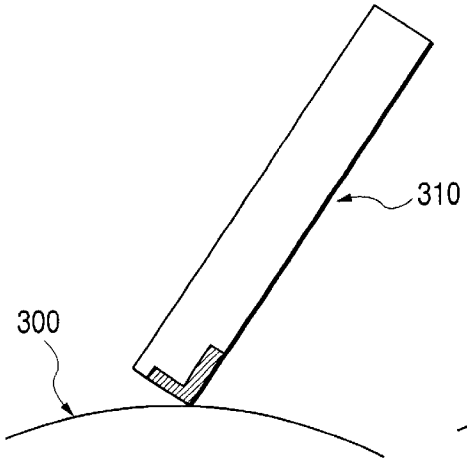
FIGS. 3A and 3B are diagrammatic views for describing how the cleaning blade of the present invention acts.
Figure 3B:
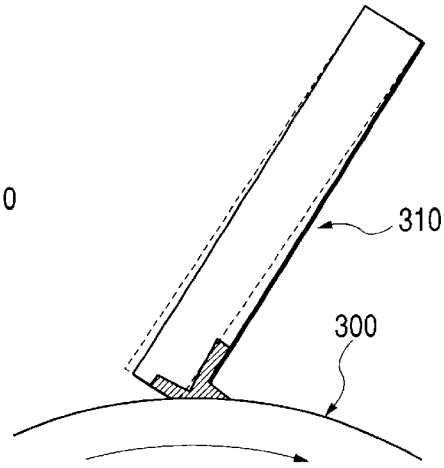

As the position at which the cleaning blade is impregnated with the isocyanate compound, it is at least the part where the cleaning blade comes into contact with the photosensitive member. It is better that its surrounding part is further impregnated therewith so as to provide enough room, i.e., to form the cured layer 150 (FIGS. 4A and 4B) described previously. This is because there is a possibility that, as shown in FIGS. 3A and 3B, the part of contact of a cleaning blade 310 with a photosensitive member 300 deforms at the time of the former's rubbing against the latter because of the rotation or movement of the photosensitive member 300, so that the part which has been the surrounding part at rest may come into touch with the photosensitive member. This deformation may be smaller as the thickness of the impregnated portion is larger, and may be greater as the thickness is smaller.

For the reason in addition to the foregoing, the thickness of the cured layer (impregnated portion) formed by impregnating the blade edge portion with the isocyanate compound may preferably be from 0.12 mm to 1.2 mm as described previously. As long as it is 0.12 mm or more, a sufficient effect can be expected against lowering of coefficient of friction due to the filming and so forth on the photosensitive-member surface, and its ware resistance can also be improved. On the other hand, as long as it is 1.2 mm or less, the time taken for impregnation can be short, and the raw-material isocyanate can be kept from heat deterioration.

The isocyanate compound with which the blade edge portion is impregnated is a compound having at least one isocyanate group in the molecule. As those having one isocyanate group, aliphatic monoisocyanates such as octadecylisocyanate and also aromatic monoisocyanates may be used.

Those having two isocyanate groups may include, but not limited to, tolylene-2,4-diisocyanate, tolylene-2,6-diisocyanate, diphenylmethane-4,4'-diisocyanate, tolylene-2,6-diisocyanate, diphenylmethane-4,4'-diisocyanate (MDI), m-phenylenediisocyanate, tetramethylenediisocyanate and hexamethylenediisocyanate. Those having three isocyanate groups may include, but not limited to, triphenylmethane-4,4',4"-triisocyanate, biphenyl-2,4',4"-triisocyanate and biphenylmethane-2,4',4"-triisocyanate. Also usable are modified products or polymers of those having three or more isocyanate groups and those having two or more isocyanate groups.

Of these, aliphatic monoisocyanates having less steric hindrance and the MDI, having a small molecular weight, are preferred in view of permeability.

As a polymerization catalyst used together with the isocyanate compound, any of quaternary ammonium salts, carboxylates (salts) and so forth may be used. These catalysts contain hydroxyl groups but function as those for polymerizing the isocyanate, and are not those participating in the cross-linked structure in themselves. These catalysts are very viscous or crystalline in the state they are not dissolved in solvents. Accordingly, such a catalyst may preferably be added to the isocyanate compound after it has been diluted with a solvent. Stated specifically, MEK (methyl ethyl ketone), toluene, tetrahydrofuran, ethyl acetate or the like may be used as the solvent. The catalyst may be diluted 1.5 to 10 times. The addition of the catalyst to the isocyanate compound may preferably be in a concentration of from 1 to 1,000 ppm. Also, the mixing of the catalyst in the isocyanate compound accelerates polymerization reaction, and hence, the former may preferably be mixed immediately before the impregnation with the latter. At the time of the impregnation, the temperature of the isocyanate compound may be, as the lower limit, the temperature at which it stands liquid, and, as the upper limit, 90° C. or below in order to prevent the isocyanate compound from deteriorating during the treatment.

The blade edge portion is impregnated with the above isocyanate compound by keeping the latter held on the former's surface for few minutes to few hours by immersion or coating. After any excess isocyanate compound is wiped off, the impregnated portion is heat-treated for few minutes to few hours in an atmosphere kept at 50 to 140° C. Urethane linkages having active hydrogen are present in the structure of polyurethane of the blade, and can react with isocyanate groups. More specifically, the active hydrogen of urethane groups in the polyurethane reacts with the isocyanate groups to produce allophanate linkages, so that a three-dimensional branched structure is formed.

The isocyanate compound having two or more isocyanate groups makes high-polymerization reaction proceed through urea linkages with intervention of water in the environment, to form a network structure together with the above three-dimensional branched structure, thus the cured layer is formed.

In those making use of the polymerization catalyst, polymerization reaction also proceeds upon its reaction. This reaction does not require any water in the environment, where the isocyanate groups react with one another, and it has a feature that the reaction completes immediately. Also, since a cross-linked structure is formed by the polymerization reaction, the cured layer can have a high strength, and a cleaning blade having a good durability can be produced.

In the case of the isocyanate compound having one isocyanate group, isocyanate groups react with urethane groups to form allophanate linkages, whereupon free terminals are oriented toward the outer side of the polyurethane surface, and hence this can prevent the urethane from coming into direct contact with the photosensitive-member surface to make the friction low. An isocyanate with lower molecular weight facilitates better impregnation, and a cured layer having a higher isocyanate density can be formed with ease. Also, control can be made with ease for layers with a small thickness up to layers with a large thickness. Layers having a high molecular weight may be inferior in impregnation properties, but are long-chain, and hence have a form in which molecular chains protrude from the polyurethane surface. This is effective for making the frictional force lower although the cured layer has a relatively small thickness.

For the cleaning blade described above, it is preferable to have an appropriate hardness in order to remove the toner without scratching the photosensitive member. It is also preferable for the cleaning blade to have an appropriate impact resilience in order to prevent the toner from slipping through and also absorb fine vibration caused by the friction with the photosensitive member. It is still also preferable for the cleaning blade to have an appropriate modulus from the viewpoint of making the blade have a longer lifetime in virtue of wear resistance. These physical properties concerning the cleaning blade are measured by measuring methods prescribed in JIS K-6251 and so forth.

As for the photosensitive member, its surface may preferably have a Vickers hardness of 4.9 $kN/m^2$ or more. As a photosensitive member having such a hard surface, commonly used is a drum-type rotatable photosensitive member having a conductive substrate made of aluminum or stainless steel and a photosensitive layer formed on the conductive substrate.

The Vickers hardness is the hardness of a sample, measured from the size of a permanent indentation produced when a pyramid diamond penetrator having an angle of 136° between the opposite faces is indented to the test face of a sample under a constant test load, and is represented by the value found when the test load used is divided by the surface area of the permanent indentation. It is measured by the test method prescribed in JIS B-7774.

As long as the photosensitive member has the surface having a Vickers hardness of 4.9 $kN/m^2$ or more, the photosensitive-member surface can be kept from being scratched, the melt adhesion of toner can also be kept from being caused by faulty cleaning, and any faulty images can be prevented from occurring. The photosensitive member with the surface having a Vickers hardness of 4.9 $kN/m^2$ or more may be formed by forming as the outermost layer of the photosensitive layer a surface layer or protective layer that achieves the above hardness. In order to assure the hardness of the photosensitive member, it is preferable to use an amorphous-silicon photosensitive member (a-Si photosensitive member).

The amorphous-silicon photosensitive member is a photosensitive member having a photosensitive layer formed of a non-single-crystal material composed chiefly of silicon atoms (amorphous silicon, a-Si). In the a-Si, other atoms may also be contained, as exemplified by atoms grouped into Group 3B of the periodic table, such as hydrogen atoms, halogen atoms, carbon atoms, oxygen atoms and boron atoms, and atoms grouped into Group 5B of the periodic table, such as nitrogen atoms. The photosensitive layer may also preferably be constructed by superposing a plurality of layers having different functions. Such a plurality of layers may be exemplified by a lower blocking layer, a photoconductive layer constituted of a charge transport layer, a charge generation layer and so forth, a buffer layer and a surface layer.

The above amorphous-silicon photosensitive member may have at its outermost surface a surface layer formed of hydrogenated amorphous carbon. This is more preferable from the viewpoint of, e.g., an improvement in surface hardness of the photosensitive member and an improvement in surface lubricity of the photosensitive member. The hydrogenated amorphous-carbon is one in which hydrogen atoms are contained in a non-single-crystal material composed chiefly of carbon (a-C:H). It may also be one which contain other atoms like those in the a-Si described previously. Also, the a-C:H chiefly represents amorphous carbon having quality intermediate between graphite and diamond. The a-C:H may also be microcrystalline or polycrystalline in part.

The amorphous-silicon photosensitive member having the above surface layer may be manufactured by a conventionally known process. Such a manufacturing process may be exemplified by a manufacturing process in which a conductive substrate is placed in a system, atom-feeding gases (source gases) containing the above atoms are introduced into the system, and plasma is caused to take place in the system to decompose the source gases and make the atoms deposit on the conductive substrate (e.g., plasma-assisted CVD). Also, the layer thickness and strength of the photosensitive layer (inclusive of the surface layer) to be formed may be controlled by, e.g., changing the density of source gases and selecting high-frequency power used in plasma discharging. The source gases may also be used after they have been diluted with hydrogen or a rare gas (inert gas).

The charging means is a means for providing the outer surface of the photosensitive-member with electric charges. As the charging means, conventionally known various charging means may be used. Such charging means may be exemplified by a corona discharge charging assembly which charges the photosensitive member electrostatically by corona discharging, a roller charging assembly which charges the photosensitive member electrostatically by means of a conductive roller member in the contact or non-contact state, a conductive-brush charging assembly which charges the photosensitive member electrostatically by means of a conductive brush in the contact state, and a magnetic-brush charging assembly which forms a magnetic brush on the roller by the aid of a magnetic force and charges the photosensitive member electrostatically in the state the magnetic brush is kept in contact therewith.

The exposure means is a means for exposing the charged photosensitive member to light to form on the photosensitive member an electrostatic latent image corresponding to an image to be formed. As the exposure means, conventionally known various exposure means may be used. Such exposure means may be exemplified by gas lasers such as a He—Ne laser, semiconductor lasers, LEDs (light-emitting diodes) and LDs (laser diodes).

The developing means is a means for feeding a developer to the photosensitive member on which the electrostatic latent image has been formed, to form a toner image. It has a developing sleeve which holds thereon a two-component developer and forms a magnetic brush by the aid of a magnetic force and is rotatable in the counter direction with respect to the photosensitive member. The two-component developer is commonly used in full-color image-forming apparatus. The construction having the developing means in plurality makes it possible to form full-color images.

The developing means may be so constructed as to have, in addition to the developing sleeve, a developer container which holds therein the developer, a developer layer thickness control member which controls the layer thickness of the developer held on the developing sleeve, an agitation member which agitates the developer held in the developer container, and a supply means which supplies non-magnetic toner particles.

In the case when the image-forming apparatus has the developing means in plurality, it may be so constructed that one developing means is disposed for one photosensitive member and a pair of these is provided in plurality. Such construction may be exemplified by the construction in which a plurality of image-forming units each having a photosensitive member, a charging means, an exposure means, a developing means, a transfer means and a cleaning means are provided side by side and, sequentially through the transfer means of these units, a transfer material is transported so that toner images on the respective photosensitive members are transferred thereto.

In the case when the image-forming apparatus has the developing means in plurality, it may also be so constructed that a plurality of developing means are disposed for one photosensitive member at the position where the former can sequentially rub the latter. Such construction may be exemplified by construction in which a drum-type rotatable developing unit having the plurality of developing means is provided and the developing unit is rotated to dispose the developing means to the position where they can sequentially rub the photosensitive member.

There are no particular limitations on the developing sleeve as long as it can hold thereon the two-component developer and form the magnetic brush by the aid of a magnetic force. Various types of conventionally known construction may be employed. Such a developing sleeve may be exemplified by the construction in which it has a non-magnetic and conductive rotating sleeve formed of aluminum or stainless steel and a magnetic-field generation means having a plurality of magnetic poles and set stationarily on the inside of the rotating sleeve.

The transfer means is a means for transferring to a transfer material the toner image formed on the photosensitive member. As the transfer means, any conventionally known transfer means of various types may be employed. A transfer means of an electrostatic transfer system may preferably be used. Such a transfer means may be exemplified by a corona transfer assembly and a bias roller transfer assembly.

The transfer means is also not limited to a means in which the toner image is directly transferred from the photosensitive member to the transfer material. A transfer means in which the toner image is transferred from the photosensitive member via an intermediate transfer means may also preferably be used. Such a transfer means may be exemplified by the construction having an intermediate transfer means which is disposed in contact with the photosensitive member and to which the toner image on the photosensitive member is transferred, and a secondary transfer means which is disposed in contact with the intermediate transfer means and through which the toner image on the intermediate transfer means is transferred to the transfer material. Also, the intermediate transfer means may be exemplified by a roller-type transfer means and a belt-type transfer means.

In the case when the image-forming apparatus has the developing means in plurality and also employs the intermediate transfer means, it may be so constructed that the toner images formed by the respective developing means are individually transferred to the intermediate transfer means and then transferred each time to the transfer material through the secondary transfer means, or may be so constructed that the toner images formed by the respective developing means are transferred from the photosensitive member to the intermediate transfer means in such a way that all the toner images are superimposed and then transferred at one time to the transfer material through the secondary transfer means.

The transfer means of an electrostatic transfer system may preferably be made up by a member having a suitable surface resistivity and volume resistivity. The member having such resistivities may be exemplified by a resin member containing a conductive fine powder such as carbon black. The resistivities may be controlled by changing the type, content and so forth of the conductive fine powder. The resin member may preferably be exemplified by silicone rubber, urethane rubber and EPDM (ethylene propylene diene monomer), or foams of these.

The transfer means may preferably have a surface layer formed of a material rich in releasability in order to improve the releasability of the toner transferred to the transfer means. Such a material may be exemplified by fluorine resins such as tetrafluoroethylene (TFE), hexafluoropropylene copolymers (FEP) and perfluroalkoxyl resins (PFA).

The image-forming apparatus may preferably have a charge elimination means for removing any electrostatic latent image remaining on the photosensitive member after cleaning. As the charge elimination means, any conventionally known charge elimination means of various types may be used. As a means for erasing the remaining electrostatic latent image by irradiating with light the photosensitive member after cleaning, it may be exemplified by gas lasers, semiconductor lasers, LEDs and LDs.

Besides the means described above, the image-forming apparatus may also optionally be provided with, e.g., a fixing means for fixing unfixed toner images held on the transfer material, and a cleaning means for removing transfer residual toner and paper dust which adhere to and remain on the transfer means.

The two-component developer preferable for the image-forming apparatus of the present invention is described below.

The two-component developer contains at least non-magnetic toner particles and a magnetic carrier. The non-magnetic toner particles are characterized in that they have a substantially spherical shape.

The shape of such toner particles may be ascertained by observation with an electron microscope. The non-magnetic toner particles may be substantially spherical toner particles having shape factors SF-1 of from 100 to 140 and SF-2 of from 100 to 120. This is preferable in order to maintain a high transfer efficiency. The use of toner particles having shape factors within these ranges can always ensure a primary transfer efficiency of 95% or more.

The SF-1 and SF-2 are defined according to the following equations, on the bases of the projected area of a toner particle in an image (an electron microphotograph or the like) of the non-magnetic toner particles, the absolute maximum length of the toner and the peripheral length of the toner particle.

$$SF\text{-}1=(MXLNG)^2/\mathrm{AREA}\times\pi/4\times100$$

$$SF\text{-}2=(PERI)^2/\mathrm{AREA}\times1/4\pi\times100$$

wherein MXLNG represents the absolute maximum length of a toner particle, PERI represents the peripheral length of the toner particle, and AREA represents the projected area of the toner particle.

The shape factors SF-1 and SF-2 are determined by obtaining an image of the non-magnetic toner particles, sampling the suitable number of toner particles in the image, analyzing the image of the toner particles thus sampled, and substituting the resultant values for the above equations to make calculation. Stated more specifically, the shape factors SF-1 and SF-2 are determined by sampling at random 100 toner particles by the use of a scanning electron microscope manufactured by Hitachi Ltd. (trade name: FE-SEM, S-800), introducing their image information in an image analyzer manufactured by Nireko Co. (trade name: LUZEX-3) through an interface to make analysis, and calculating the data according to the above equations.

The non-magnetic toner particles may have a weight-average particle diameter of from 6 μm to 10 μm. This is preferable in order to form good images. As long as its weight-average particle diameter is within this range, sharp and high-quality images having a sufficient definition can be formed, and adhesive force and cohesive force can be smaller than electrostatic force, so that various troubles may be suppressed.

The weight-average particle diameter of the non-magnetic toner particles may be measured by various methods such as sieving, sedimentation and photon correlation. For example, the weight-average particle diameter of the non-magnetic toner particles may be measured in the following way: As a measuring device, Coulter Multisizer (trade name), manufactured by Coulter Electronics, Inc.) is used. As an aqueous electrolytic solution, an aqueous 1% NaCl solution is prepared using guaranteed or first-grade sodium chloride (for example, ISOTON R-II, trade name, manufactured by Coulter Scientific Japan Co. may be used). As a dispersant, 0.1 to 5 mL of a surface active agent, preferably an alkylbenzene sulfonate, is added to 100 to 150 mL of the aqueous electrolytic solution, and 2 to 20 mg of the toner, a sample to be measured, is further added. The electrolytic solution in which the sample has been suspended is subjected to dispersion for about 1 minute to about 3 minutes in an ultrasonic dispersion machine. The volume distribution and number distribution of the toner are calculated by measuring the volume and number of toner particles, using an aperture of 100 μm. Then the weight-average particle diameter determined from the volume distribution of toner particles are determined (the middle value of each channel is used as the representative value for each channel).

The non-magnetic toner particles may be produced by a conventionally known process. The non-magnetic toner particles may be produced by a pulverization process in which constituent materials are heated and uniformly melt-kneaded, and the kneaded product obtained is cooled to solidify, followed by pulverization to produce toner particles. Since, however, the toner particles obtained by this pulverization are commonly amorphous (having no definite form), mechanical, thermal or some special treatment must be made in order to make the particles substantially spherical, and, in order to make them have the weight-average particle diameter described above, toner particles having been sphericity-treated must be classified. Accordingly, as a preferred production process for the non-magnetic toner particles, it is preferable to employ a polymerization process.

As processes for producing the toner by polymerization (a polymerization toner), various production processes are known, as exemplified by soap-free polymerization, two-stage swelling polymerization, and dispersion polymerization such as emulsion polymerization and suspension polymerization. In particular, where it is intended to obtain toner particles having the desired particle diameter at the first stage of polymerization reaction, the two-stage swelling polymerization and the dispersion polymerization, in particular, suspension polymerization are advantageous. From the viewpoint of the simplicity of steps, the quality of products and so forth, suspension polymerization is more advantageous.

The suspension polymerization is a production process suited for producing the non-magnetic toner particles. The suspension polymerization is a process in which oily materials of toner particles are introduced in an aqueous dispersion medium containing a suitable dispersion stabilizer to form monomer-system droplet particles in the aqueous dispersion medium, and in this state the monomer system is polymerized to produce toner particles. In the monomer system, for example a polymerizable monomer and a colorant, and optionally a polymerization initiator, a cross-linking agent, a release agent, a plasticizer, a charge control agent and other additives are contained as the materials of toner particles.

At the time of suspension, toner particles may be made to have the desired toner particle diameter at a stretch by using a high-speed dispersion machine such as a high-speed stirrer or an ultrasonic dispersion machine. This is preferable in order to make the resultant toner particles have a sharp particle size distribution. The polymerization initiator may be added to the monomer system simultaneously with other additives, or may be added in the monomer system or aqueous dispersion medium before the granulation of droplet particles or after the granulation of droplet particles. In this case, the polymerization initiator may be added by dissolving it in the monomer system or in a suitable solvent.

After the granulation has been completed by the polymerization of the monomer system, the resultant system may be stirred by means of a usual stirrer to such an extent that the state of particles is maintained and also the particles are prevented from floating or settling.

After the polymerization has been completed, filtration, washing and drying may be carried out by known methods to obtain the desired toner particles. Also, a classification step may be added to the production steps to cut coarse powder and fine powder. This is also one of preferred embodiments of producing the non-magnetic toner particles. In the classification step, the toner particles obtained may be classified into particles with prescribed particle diameters. Toner particles having different particle diameters may be blended to prepare toner particles having the desired particle size distribution.

Figure 1:
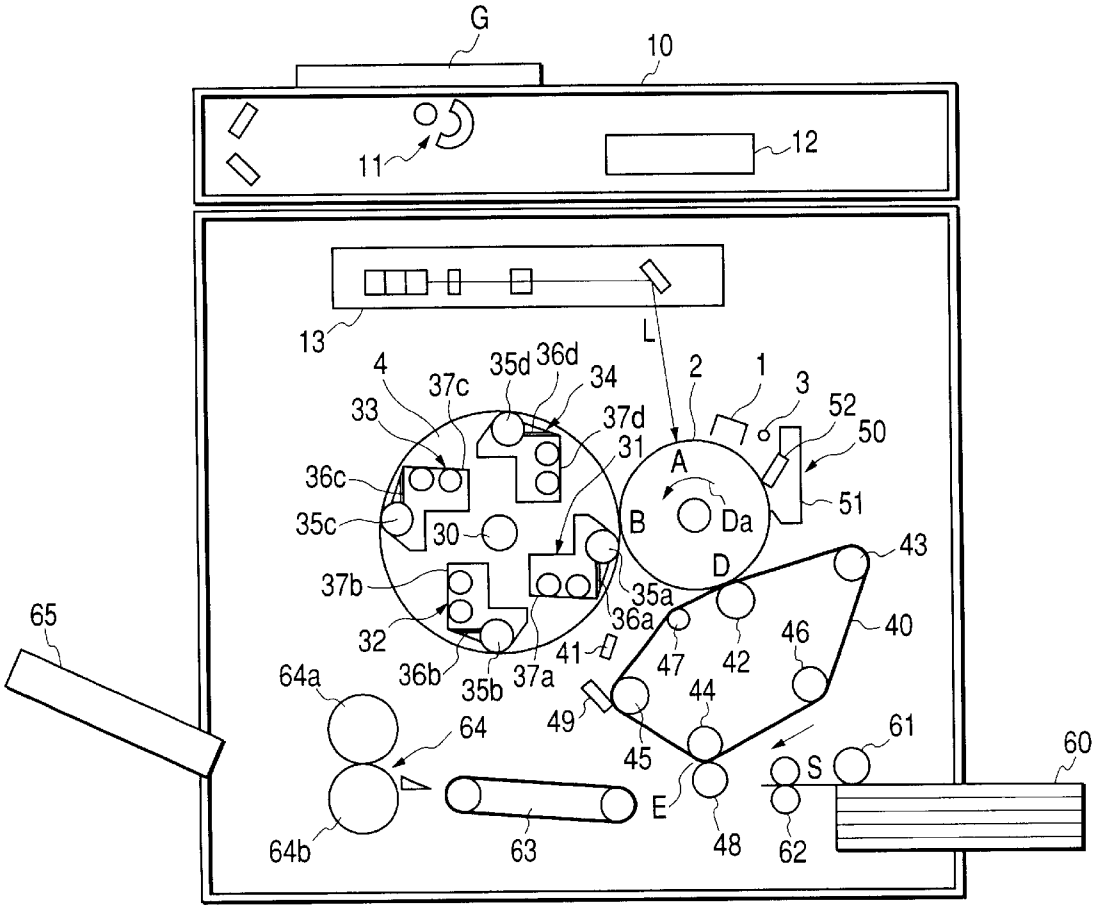
FIG. 1 is a diagrammatic sectional view for describing an example of the image-forming apparatus of the present invention.

As the image-forming apparatus of the present invention, it may be constructed as shown in FIG. 1, for example. As a cleaning blade 52 which constitutes a cleaning means (cleaner) 50, a cleaning blade 52 is used having the cured layer formed at its edge portion which comes into contact with an image-bearing member (photosensitive member) 2, by impregnating that portion with the isocyanate compound followed by curing, and the impregnation-treated portion (cured layer) is in a thickness of from 0.12 mm to 1.2 mm. Thus, any foreign matter such as paper dust and corona products can be prevented from adhering to the surface of the photosensitive member 2. Hence, according to the image-forming apparatus of the present invention, lowering of image quality can be prevented from deteriorating due to the occurrence of filming, even in full-color image-forming apparatus making use of two-component developers, making it possible to form images with high image quality. FIG. 1 shows an example of such full-color image-forming apparatus, in which four developing assemblies 31 to 34 are provided.

Employment of such a construction as described above can realize the image-forming apparatus which can maintain the surface state of a photosensitive member that does not cause any smeared images or melt adhesion of toner even when the non-magnetic toners are used, promising great improvement in reliability, and also can deal with any situations even where the productivity has dramatically been advanced. In particular, it enables performance of the full-color image-forming apparatus to be improved.

EXAMPLES

The present invention is described below in greater detail by giving Examples. However, the present invention is by no means limited thereto. In the following, as reagents and so forth, commercially available high-purity products are used unless otherwise indicated.

Example 1

The whole of an image-forming apparatus used in this Example is shown in FIG. 1.

The image-forming apparatus used in this Example has a photosensitive member 2, a charging means charging assembly 1, an exposure means ROS (image writing unit) 13, a developing means developing roll 4 having four developing assemblies 31 to 34, a transfer means intermediate transfer belt 40 and a secondary transfer assembly 48, a cleaning means cleaner 50, a charge elimination means pre-exposure unit 3, a fixing assembly 64, a paper feed-and-delivery system, and so forth.

The photosensitive member 2 is a negatively chargeable amorphous-silicon photosensitive member which is constituted of a hollow aluminum cylinder of 80 mm in diameter and about 3 mm in wall thickness and an amorphous-silicon photosensitive layer of 30 $\mu$m in thickness formed thereon by glow discharging. As the surface layer of the photosensitive member 2 in this Example, a layer formed by depositing a-SiC:H (hydrogenated amorphous-silicon carbide) in a thickness of 800 nm is used.

The charging assembly 1 is a corona discharging charging assembly, and has a discharge wire formed of tungsten and a cross-sectionally U-shaped casing whose opening is directed to the photosensitive member 2.

The ROS 13 has a laser beam generation unit which generates laser beams in accordance with images having been read. In the light path of a laser beam L, an imaging lens, a mirror and so forth are appropriately disposed.

An image-reading means has an original glass plate 10, a light source 11 which emits light to the original glass plate 10, a CCD (charge-coupled device) which converts the light reflecting from the original glass plate 10, into electrical signals of red (R), green (G) and blue (B), and an IPS (image processing system) which receives the electrical signals of R, G and B inputted from the CCD to convert them into image data of black (K), yellow (Y), magenta (M) and cyan (C), and outputs to the laser beam generation unit the electrical signals corresponding to the images thus converted. Here, letter symbol G denotes an original.

The developing assembly 31 has a developer container 37*a* holding therein a K two-component developer, a developing sleeve 35*a* provided rotatively at an opening of the developer container 37*a,* a control blade 36*a* which controls the developer held on the developing sleeve 35*a* to control the height of ears of a magnetic brush formed on the sleeve, a rotary rod for agitating the developer held in the developer container 37*a,* and a power source (not shown) which applies a voltage to the developing sleeve 35*a.* Inside the developing sleeve 35*a,* a magnet member (not shown) having a plurality of magnetic poles is stationarily set. A developing assembly 32 holds therein a Y developer, a developing assembly 33 a M developer, and a developing assembly 34 a C developer, and these have the same construction as the developing assembly 31 except for the developers held therein.

The developing assemblies 31 to 34 are provided in a rotatable developing roll 4. The developing roll 4 which has a rotating shaft 30 and is rotated so that developing assemblies corresponding to color data of electrostatic latent images are transported to a developing zone B at the time of development. It constitutes a rotary-type developing means. By this developing roll 4, the developing sleeves 35*a* to 35*d* are, at least at the time of development, so disposed that their closest regions come to be about 400 $\mu$m with respect to the photosensitive member 2, and are so disposed that the magnetic brush on each developing sleeve can develop the electrostatic latent images in the state it comes into contact with the photosensitive member 2.

At the lower part of the photosensitive member 2, provided are an intermediate transfer belt 40, a plurality of belt-supporting rolls including a belt drive roll 45, a tension roll 43, idler rolls 46 and 47 and a back-up roll 44 for secondary transfer, a primary transfer roll 42, a belt frame (not shown) which support these, and a blade type belt cleaner 49 for removing residual toner and so forth adhering to the intermediate transfer belt 40 before transfer. Then, the intermediate transfer belt 40 is rotatively supported by the belt-supporting rolls.

At a position kept separate from the intermediate transfer belt 40, a position sensor 41 is provided which detects a home position provided at a non-transfer portion of the intermediate transfer belt. Also, at the position facing the back-up roll 44 for secondary transfer via the intermediate transfer belt 40, a secondary transfer assembly 48 is provided which is to transfer the intermediately transferred toner images to a transfer material recording sheet.

The intermediate transfer belt 40 has a double-layer structure consisting of a polyimide layer and a cyano-resin layer (a layer with high dielectric constant). This intermediate transfer belt 40 is produced in the following way. With regard to a base layer heat-curable seamless belt with carbon black dispersed therein, carbon black is mixed in Polyimide Varnish U (trade name; available from Ube Industries, Ltd.) for heat-resistant films, followed by mixing by means of a mixer. The liquid material thus obtained is poured into a cylindrical mold to carry out centrifugal molding with heating. The molded-product belt obtained is demolded in a half-cured state, and thereafter the belt demolded is placed over an iron core and then heated to 400° C. to 450° C. to effect main curing (imide-forming reaction) to obtain a seamless belt having a surface resistivity of $10^{12}$ Ω/square and a volume resistivity of $10^{10}$ Ω·cm and having a thickness of 75 $\mu$m.

As for the layer construction of the back-up roll 44, which is a supporting roll for the intermediate transfer belt 40 and also serves as a counter electrode of the secondary transfer assembly 48, it may be either of a single layer and a multiple layer. For example, in the case of a single layer, it is constituted of a roll made of silicone rubber, urethane rubber, EPDM (ethylene propylene diene monomer) or the like in which a conductive fine powder such as carbon black has been mixed in an appropriate quantity. In the case of a double layer, the back-up roll 44 is constituted of a core layer comprised of a foam of silicone rubber, urethane rubber, EPDM or the like whose resistivity has appropriately been controlled and a skin layer, formed on its periphery, comprised of silicone rubber, urethane rubber, EPDM or the like in which a conductive agent such as carbon black has been mixed. The back-up roll 44 may preferably have a volume resistivity within the range of from $10^7$ to $10^9$ Ω·cm.

The layer construction of the secondary transfer assembly 48 is not particularly limitative. For example, in the case of a double layer, it consists of a core layer and a coating layer with which the former is covered. The core layer is comprised of silicone rubber, urethane rubber, EPDM or the like in which a conductive powder has been dispersed, or a foam of any of these. The coating layer may preferably be comprised of a fluorine resin type material with a conductive powder dispersed therein. The fluorine resin may include tetrafluoroethylene (TFE), hexafluoropropylene copolymers (FEP) and perfluroalkoxyl resins (PFA). The secondary transfer assembly 48 may preferably have a volume resistivity within the range of from $10^6$ to $10^9$ Ω·cm.

The cleaner 50 has a cleaning blade 52 kept in contact with the surface of the photosensitive member 2, and a cleaning container 51 which holds the cleaning blade and receives toner particles and so forth removed by the cleaning blade.

The cleaning blade 52 was produced in the following way: In a prepolymer having NCO% of 7.0%, produced from an ethylene-butylene adipate type polyester polyol having a molecular weight of 2,000 and diphenylmethane-4,4'-diisocyanate (MDI), a cross-linking agent prepared by mixing 1,4-butanediol and trimethylolpropane in a weight ratio of 65:35 and containing a triethylenediamine catalyst was so mixed as to have a hydroxyl group/isocyanate group molar ratio of 0.9, followed by molding to produce a cleaning blade made of urethane, having a hardness of 70° (JIS-A), an impact resilience of 15% (impact resilience at 40° C.: 15%) and a 300% modulus of 200 kg/cm$^2$ (all according to JIS K-6251). This cleaning blade was so masked with a chemical-resistant tape as to be L1=L2=3 mm, and then immersed in a 80° C. MDI (diphenylmethane-4,4'-diisocyanate) bath for 30 minutes. Then, any excess isocyanate was wiped off, and the masking tape was removed, followed by curing for 60 minutes in a 130° C. oven. The cured layer thus formed had a coefficient of friction of 0.6 to a PET film (HEIDON surface property tester/width: 50 mm; load: 20 g/10 mm; movement speed: 10 cm/minute). Also, in its section, the cured portion was found to stand cloudy in white. According to microscopic observation, the cured portion was in a thickness of 0.7 mm. The cured portion had a hardness of 80° (JIS-A).

The cleaning blade 52 is set against the photosensitive member under a contact pressure of 196 mN/cm at a contact angle of 24°. The cleaning blade has a thickness of 3 mm, and as its back plate a SUS stainless steel plate (plate thickness: 1.0 mm) is provided. The free length of the cleaning blade is 7 mm.

Figure 2:
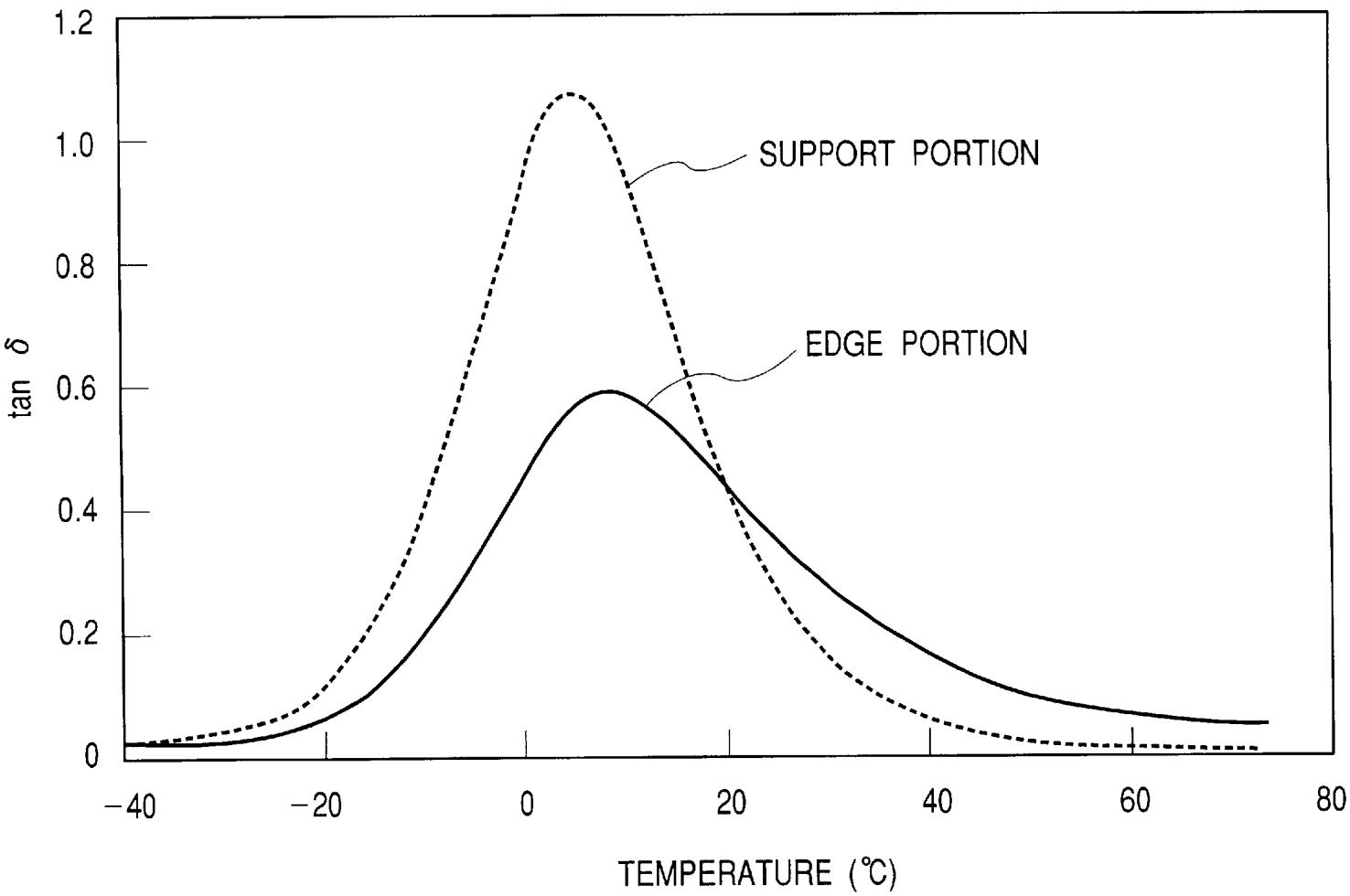
FIG. 2 is a graph showing the temperature dependence of tan δ.

The temperature dependence of the loss tangent of the cured layer (edge portion) and the temperature dependence of the loss tangent of the support portion were also measured to obtain the results shown in FIG. 2. From the results, it was found that the peak temperature (t1) of the loss tangent of the edge portion was 8° C., that the peak temperature (t2) of the loss tangent of the support portion was 3° C., that the value at the peak temperature (t1) of the loss tangent of the edge portion, tan δ1, was 0.6, that the value at the peak temperature (t2) of the loss tangent of the support portion, tan δ2, was 1.08, and that the curve representing the temperature dependence of the loss tangent of the edge portion and the curve representing the temperature dependence of the loss tangent of the support portion intersected at 20° C.

The pre-exposure unit 3 is a light-emitting diode (element: GaAlAs) whose peak wavelength is chiefly 660 nm. In the pre-exposure unit 3, the half width where the value comes to be ½ of the peak wavelength is about 25 nm, and the amount of exposure is 20 μJ/cm$^2$. The time of movement of the photosensitive-member 2 surface from the pre-exposure unit 3 to the charging assembly 1 is about 50 mm/sec.

The fixing assembly 64 has a heating roll 46*a* and a pressure roll 46*b* disposed facing this heating roll 46*a*.

The paper feed-and-delivery system has a paper feed tray 60 which holds recording sheets S, a pick-up roll 61 for taking out sheet by sheet the recording sheets held in the tray, a registration roll pair 62 which transport each recording sheet to the secondary transfer assembly 48 in synchronization with the movement of the transfer means, a sheet transport belt 63 which transports to the fixing assembly 64 the recording sheet to which the toner image has secondarily been transferred, and a recording sheet take-off tray 65 to which the recording sheet having images fixed by the fixing assembly 64 is delivered.

The two-component developers used in this Example were each a blend of non-magnetic toner particles produced by suspension polymerization, a resin magnetic carrier produced by polymerization and abrasive particles, and were prepared as four color toners using colorants for the respective four colors. The T/D ratio, the weight ratio of the toner particles to the sum of which is a toner particles and the magnetic carrier of each developer obtained, was 8%. The magnetic carrier had a resistivity of $10^{13}$ Ω·cm. Also, the non-magnetic toner particles were substantially spherical polymerization toner particles with smooth surfaces, having shape factors SF-1 of 115 and SF-2 of 110, and having a weight-average particle diameter of 8 μm and an average charge quantity of 25 μC/g per unit mass at a density of 1.95 g/cm$^3$. Also, the abrasive particles were alumina particles having a Mohs hardness of 9 and an average particle diameter of 1.2 μm and having been added to the non-magnetic toner particles in an amount of 1% by weight.

In the image-forming apparatus according to this Example, the maximum image width is 320 mm, which is A4-sheet transverse length plus elongation-adaptable length. Also, in this Example, the peripheral speed of the photosensitive member is 300 mm/sec.

In the apparatus shown in FIG. 1, the light reflecting from the original G placed on the original glass plate 10 is converted into electrical signals of R (red), G (green) and B (blue) by means of the CCD through the exposure optical system. The IPS (image processing system) converts the electrical signals of R, G and B inputted from the CCD 12, into image data of K (black), Y (yellow), M (magenta) and C (cyan) to store them temporarily, and outputs them at a given timing to a laser drive circuit (not shown) as image data for latent-image formation. The laser drive circuit outputs laser drive signals (not shown) to the ROS 13 in accordance with the image data inputted thereto.

The photosensitive member 2 is rotated in the direction of an arrow Da. Its surface is uniformly electrostatically charged by the charging assembly 1 and thereafter, at a latent-image writing position A, exposure-scanned by the laser beams L (chief wavelength: 655 nm) of the ROS 13, whereupon an electrostatic latent image is formed. In the case of full-color image formation, electrostatic latent images corresponding to the K (black), Y (yellow), M (magenta) and C (cyan) four color images are sequentially formed. In the case of black monochromatic image formation, only an electrostatic latent image corresponding to the K (black) image is formed.

The writing of the latent image onto the surface of the photosensitive member 2 by the laser beam L is started on the passage of a stated time after the belt position sensor 41 has detected the home position provided at a non-image portion of the intermediate transfer belt 40. In the case of full-color images, since the respective colors are superimposed, the time taken until the writing of the latent image by the laser beam L is started after the belt position sensor 41 has detected the home position is the same for each color.

The photosensitive-member 2 surface on which the electrostatic latent image has been formed moves rotatively and passes through a developing zone B and a primary transfer zone D successively. The developing assemblies 31 to 34 are transported to the developing position as the developing roll 4 is rotated, and each make into a toner image the electrostatic latent image formed on the photosensitive-member 2 surface passing through the developing zone B.

Here, the step of development performed by a two-component magnetic brush method in this Example is described. First, the developer attracted by the aid of the N2 pole of the magnet member as the developing sleeve 35*a* is rotated is, in the course of transportation from the S2 pole to the N1 pole, controlled by the control blade 36*a* disposed vertically to the developing sleeve 35*a,* and is formed in a thin layer on the developing sleeve 35*a.* The developer formed in a thin layer is transported to the developing main pole S1, where ears raised by its magnetic force are formed, so that a magnetic brush attributable to the magnetic carrier is formed on the developing sleeve 35*a.*

This developer formed in ears rubs the surface of the photosensitive member 2. Here, the toner particles move to the photosensitive member 2 to develop the electrostatic latent image. The magnetic carrier which forms the magnetic brush and the abrasive particles do not actively move to the photosensitive member 2 and remain on the developing sleeve 35*a.* Thereafter, the developer remaining on the developing sleeve 35*a* is returned to the inside of the developer container 37*a* by the action of a repulsion magnetic field of the N3 pole and N2 pole.

To the developing sleeve 35*a,* a DC voltage and an AC voltage are applied from a power source (not shown). In this Example, with respect to the photosensitive member surface potential Vd of −450 v and Vl of −50 v, a voltage of −300 V as the DC voltage and a voltage with Vpp of 1,500 V and Vf of 2,000 Hz as the AC voltage are applied. In general, in the two-component development, the application of AC voltage makes development efficiency higher to render image quality higher, but on the other hand there is a possibility that fog tends to occur. Accordingly, in usual cases, a potential difference is set between the DC voltage applied to the developing sleeve 35*a* and the surface potential of the photosensitive member 2 to achieve the prevention of fog.

In this Example, the developing sleeves 35*a* to 35*d* are rotated at a peripheral speed of 450 mm/sec. in the counter direction to the rotation of the photosensitive member at a peripheral speed of 300 mm/sec. The rotational load torque of the developing sleeve 35*a* is 0.038 N.m. The rotational load torque as the rubbing function attributable to the magnetic brush on the developing sleeve 35*a* may preferably be from 0.02 to 0.06 N.m.

In the case of full-color image formation, the first-color electrostatic latent image is formed at the latent-image writing position A and the first-color toner image is formed at the developing zone B. This toner image is, when passing through the primary transfer zone D, electrostatically primarily transferred onto the intermediate transfer belt 40 by the aid of the primary transfer roll 42. Thereafter, on the intermediate transfer belt 40 holding the first-color toner image thereon, the second-color toner image, the third-color toner image and the fourth-color toner image are likewise sequentially primary-transferred and superposed, and finally a full-color multiple toner image is formed on the intermediate transfer belt 40. In the case of monochromatic black-and-white image formation, only the developing assembly 31 is used, and a monochromatic toner image is primarily transferred onto the intermediate transfer belt 40.

After the primary transfer, the residual toner on the surface of the photosensitive member 2 is removed by means of the cleaning blade 52.

The recording sheets S held in the paper feed tray 60 are taken out sheet by sheet by the pick-up roll 61 at a given timing, and are each transported to the registration roll pair 62. The registration roll pair 62 transports each recording sheet S to a secondary transfer zone E in synchronization with the movement of the primarily transferred multiple toner image or monochromatic toner image to the secondary transfer zone E. In the secondary transfer zone E, the secondary transfer assembly 48 electrostatically secondarily transfers the toner image(s) held on the intermediate transfer belt 40, at one time (in the case of the multiple toner image) to the recording sheet S. The intermediate transfer belt 40 after the secondary transfer is cleaned by the belt cleaner 49, and the residual toner on the belt is removed. The secondary transfer assembly 48 and the belt cleaner 49 are provided separably from the intermediate transfer belt 40. In the case of full-color image formation, they stand separated from the intermediate transfer belt 40 until the final-color unfixed toner image is primarily transferred to the intermediate transfer belt 40.

The recording sheet S to which the multiple or monochromatic toner image has been transferred is transported to the fixing assembly 64 by the sheet transport belt 63, and heat-fixed by the fixing assembly 64. The recording sheet S to which the toner image has been fixed is delivered to the recording sheet take-off tray 65.

In this Example, using the above image-forming apparatus, images were formed in a high temperature and high humidity (32.5° C./85%RH) environment. As a result, in this Example, any smeared images did not occur even after extensive operation on 3,000,000 sheets and even in the high temperature and high humidity environment. Also, any problems such as chipping did not occur at the cleaning blade edge portion.

Then, as a result of inspection made on the photosensitive member 2 after the extensive-operation test, any problems which may cause faulty images, such as melt adhesion of toner, any local filming layers and rub scratches, were found not to have occurred at all even after the extensive operation on 3,000,000 sheets. Also, the level of wear after rotated 10,000 times was 0.4 nm, which was 0.05% of the initial thickness of the photosensitive member surface layer. Still also, the photosensitive member 2 after the 3,000,000-sheet extensive operation was heated (70° C. to 80° C., 30 minutes) in an aqueous 5% sodium peroxodifulfate ($Na_2S_2O_8$) solution, followed by ultrasonic cleaning (about 1 minute) in acetone and then rinsing with ethanol/pure water. Its surface before and after such treatment was examined with a reflection spectro-interferometer (manufactured by Otsuka Denshi K.K.; trade name: MCDP2000) to find that no filming layer was seen.

Example 2

In this Example, as the cleaning blade, a urethane rubber having a hardness (JIS-A) of 70° and an impact resilience of 35% was used, and its edge portion was treated and cured in the same manner as that in Example 1. Here, as to the behavior concerning loss tangents of the edge portion and support portion, it was found that the peak temperature (1) of the loss tangent of the edge portion was −3° C., that the peak temperature (2) of the loss tangent of the support portion was −8° C., that the value at the peak temperature (t1) of the loss tangent of the edge portion, tan δ1, was 0.35, that the value at the peak temperature (t2) of the loss tangent of the support portion, tan δ2, was 0.5, and that the curve representing the temperature dependence of the loss tangent of the edge portion and the curve representing the temperature dependence of the loss tangent of the support portion intersected at 20° C.

Even after a 3,000,000-sheet extensive-operation test made in the same manner as in Example 1 in a high temperature and high humidity (32.5° C./85% RH) environment, any smeared images did not occur. Also, any problems such as chipping did not occur at the cleaning blade edge portion. Also, the level of wear of the surface of the photosensitive member 2 at the time of its 10,000 rotation after the extensive-operation test was 0.5 nm, which was 0.06% of the initial thickness of the photosensitive member surface layer. In the inspection made on the photosensitive member 2 after the extensive-operation test, any problems which may cause faulty images, such as melt adhesion of toner, local filming layers and rub scratches, were found not to have occurred at all even after the 3,000,000-sheet extensive operation.

Example 3

In this Example, the extensive-operation test was made under the same construction as in Example 1 except that, in place of the a-SiC:H, a-C:H (hydrogenated amorphous carbon) was deposited as the photosensitive member surface layer. It was ascertained that the hydrogenated amorphous carbon surface layer has a smaller coefficient of friction than the conventional a-SiC:H surface layer. Also, the Vickers hardness of the surface of the photosensitive member 2 in this Example was 10.8 kN $m^2$.

In this Example, even after a 3,000,000-sheet extensive-operation test made in the same manner as in Example 1 in a high temperature and high humidity (32.5° C./85%RH) environment, any smeared images did not occur. Also, any problems such as chipping did not occur at the cleaning blade edge portion. Also, in the inspection made on the photosensitive member 2 after the extensive-operation test, any problems which may cause faulty images, such as melt adhesion of toner, local filming layers and rub scratches, were found not to have occurred at all even after the 3,000,000-sheet extensive operation.

The level of wear of the surface of the photosensitive member 2 in this Example was 0.02 nm at the time of its 10,000 rotation, which was 0.06% of the initial thickness of the photosensitive member surface layer.

In addition, its coefficient of friction after the extensive operation was also smaller than that of the a-SiC:H surface layer. The reason is presumed to be that the hydrogenated amorphous carbon layer has a smaller surface free energy than the a-SiC:H layer and hence organic matter such as ozone products and toner components and paper dust may hardly adhere or stick to the photosensitive-member surface, so that filming layers may be difficult to form.

Example 4

In this Example, the extensive-operation test was made under the same construction as in Example 1 except that non-magnetic toner particles having the same composition as those in Example 1 but produced by pulverization were used. Those having been so adjusted that their average particle diameter was equal to that of the toner particles in Example 1 were used as the non-magnetic toner particles. The non-magnetic toner particles had shape factors SF-1 of 200 and SF-2 of 180. The level of wear of the surface of the photosensitive member at the time of its 10,000 rotation was 10 nm, which was 6.25% of the initial value.

Example 5

The cleaning blade was formed in the same manner as in Example 1 except that its cured layer was formed in a thickness of 0.08 mm. The coefficient of friction of the photosensitive member surface layer was also measured in the same manner as in Example 1 to find that it was 0.8. The extensive-operation test was also made in the same manner as in Example 1, but faulty cleaning occurred as of 300,000 sheets. The edge portion of the cleaning blade was observed to find that the edge was damaged in part.

Comparative Example

In this Comparative Example, a cleaning blade was used without forming any cured layer in the urethane rubber used in Example 2. The coefficient of friction of the photosensitive member surface layer was also measured in the same manner as in Example 1 to find that it was 2.0. In the extensive-operation test made in the same manner as in Example 1, the melt adhesion of toner occurred as of 50,000 sheets.

What is claimed is:

1. An image-forming apparatus comprising a cleaning means provided with at least a cleaning blade, and an image-bearing member to be cleaned by the cleaning member, wherein said cleaning blade comprises an edge portion which is brought into contact with said image-bearing member, and a support portion which brings the edge portion into contact with said image-bearing member;

a value at a peak temperature t1 of a loss tangent of the edge portion, tan δ1, is smaller than a value at a peak temperature t2 of a loss tangent of the support portion, tan δ2; and a curve which represents the temperature dependence of the loss tangent of the edge portion and a curve which represents the temperature dependence of the loss tangent of the support portion intersect at t1° C. or above to t1+40° C. or below.

2. The image-forming apparatus according to claim 1, wherein said image-bearing member is a drum-type photosensitive member provided rotatively, and, when the photosensitive member has been rotated 10,000 times, the photosensitive-member surface layer having been abraded and removed by said cleaning blade has a layer thickness of 50% or less of the layer thickness of the photosensitive-member surface layer before abraded.

3. The image-forming apparatus according to claim 2, wherein said image-bearing member is an amorphous silicon photosensitive member.

4. The image-forming apparatus according to claim 1, wherein said cleaning blade is formed chiefly of a polyurethane resin, and said edge portion is a cured layer formed by reaction of the polyurethane resin with an isocyanate compound.

5. The image-forming apparatus according to claim 4, wherein said cured layer has a layer thickness T of from 0.12 mm to 1.2 mm.

6. The image-forming apparatus according to claim 4, wherein said cured layer has a length in the free-length direction, L1, of 0.2 mm or more, and a length in its thickness direction, L2, of 0.2 mm or more.

7. The image-forming apparatus according to claim 4, wherein said cured layer is formed by impregnating the edge portion of said cleaning blade with the isocyanate compound and thereafter allowing the polyurethane resin to react with the isocyanate compound.

8. The image-forming apparatus according to claim 1, which is a full-color image-forming apparatus.

9. A cleaning blade comprising an edge portion which is brought into contact with said image-bearing member, and a support portion which brings the edge portion into contact with said image-bearing member, wherein the value at a peak temperature t1 of a loss tangent of the edge portion, tan δ1, is smaller than the value at a peak temperature t2 of a loss tangent of the support portion, tan δ2; and a curve which represents the temperature dependence of the loss tangent of the edge portion and a curve which represents the temperature dependence of the loss tangent of the support portion intersect at t1° C. or above to t1+40° C. or below.

10. The cleaning blade according to claim 9, which is formed chiefly of a polyurethane resin and wherein said edge portion is a cured layer formed by reaction of the polyurethane resin with an isocyanate compound.

11. The cleaning blade according to claim 9, wherein said cured layer has a layer thickness T of from 0.12 mm to 1.2 mm.

12. The cleaning blade according to claim 9, wherein said cured layer has a length in its free-length direction, L1, of 0.2 mm or more, and a length in its thickness direction, L2, of 0.2 mm or more.

* * * * *

UNITED STATES PATENT AND TRADEMARK OFFICE

CERTIFICATE OF CORRECTION

PATENT NO. : 6,704,539 B2
DATED : March 9, 2004
INVENTOR(S) : Yuji Nakayama

It is certified that error appears in the above-identified patent and that said Letters Patent is hereby corrected as shown below:

Column 1,
Line 32, “absolute” should read -- an absolute --; and
Line 33, “subjects” should read -- subject --.

Column 2,
Line 59, “materials” should read -- material --.

Column 3,
Line 42, “experiment” should read -- an experiment --;
Line 50, “little” should be deleted; and
Line 51, “changes” should read -- changes little --.

Column 14,
Line 65, “make calculation” should read -- make a calculation --.

Column 15,
Line 19, “Inc.)” should read -- Inc., --.

Column 17,
Line 62, “a M” should read -- an M --.

Column 19,
Line 28, “a 80°C.” should read -- an 80°C. --.

Column 23,
Line 2, “peak temperature (1)” should read -- peak temperature (t1) --; and
Line 4, “peak temperature (2)” should read -- peak temperature (t2) --.

Signed and Sealed this

Thirteenth Day of July, 2004

JON W. DUDAS
*Acting Director of the United States Patent and Trademark Office*